US011017754B2

(12) United States Patent
Teng

(10) Patent No.: US 11,017,754 B2
(45) Date of Patent: May 25, 2021

(54) SINGING SCORING METHOD AND SINGING SCORING SYSTEM BASED ON STREAMING MEDIA

(71) Applicant: C-MEDIA ELECTRONICS INC., Taipei (TW)

(72) Inventor: Jei-Wen Teng, Keelung (TW)

(73) Assignee: C-MEDIA ELECTRONICS INC., Taipei (TW)

( * ) Notice: Subject to any disclaimer, the term of this patent is extended or adjusted under 35 U.S.C. 154(b) by 15 days.

(21) Appl. No.: 16/747,600

(22) Filed: Jan. 21, 2020

(65) Prior Publication Data

US 2021/0090541 A1 Mar. 25, 2021

(30) Foreign Application Priority Data

Sep. 24, 2019 (TW) ..... 108134485

(51) Int. Cl.

*G10H 1/36* (2006.01)
*G10L 25/81* (2013.01)
*G10L 25/87* (2013.01)

(52) U.S. Cl.

CPC ..... *G10H 1/365* (2013.01); *G10L 25/81* (2013.01); *G10L 25/87* (2013.01); *G10H 2210/005* (2013.01); *G10H 2210/076* (2013.01); *G10H 2210/091* (2013.01)

(58) Field of Classification Search

CPC .... G06T 2207/10016; G10H 2210/066; G10H 2240/131; G10H 2210/091; G10H 1/36; G10H 1/365; G10H 1/366; G10H 2210/076; G10H 2220/015; G10H 2240/305; G10H 2220/011; G10H 2210/081; G10H 1/361; G10H 2220/145; G10H 2240/325; G10H 1/0033; G10H 2210/005; G10H 2210/031; G10H 2240/141; G10H 2240/135; G10H 2240/145; G10H 2240/205; G10H 2240/125; G10G 1/00

See application file for complete search history.

(56) References Cited

U.S. PATENT DOCUMENTS 8,907,195 B1 * 12/2014 Erol ..... G10H 1/361 84/609
9,412,390 B1 * 8/2016 Chaudhary ..... G10L 21/00
2009/0038467 A1 * 2/2009 Brennan ..... G09B 15/00 84/609

(Continued)

*Primary Examiner* — Marlon T Fletcher
(74) *Attorney, Agent, or Firm* — Li & Cai Intellectual Property (USA) Office

(57) ABSTRACT

A singing scoring method and a singing scoring system based on streaming media are provided. In the singing scoring method and the singing scoring system, a first time difference between a moment at which a streaming video player starts to play a song and a moment at which an electronic device starts an audio recording program and a scoring engine is calculated. In addition, in the singing scoring method and the singing scoring system, a playing time difference of the streaming video player within every fixed period of a system time of the electronic device is continuously calculated, and the playing time difference is transferred to the scoring engine for accumulation to form a second time difference. The scoring engine then adjusts a singing time of each note in an entire musical score according to the first time difference and the second time difference.

20 Claims, 2 Drawing Sheets

(56) References Cited

U.S. PATENT DOCUMENTS

| | | | | |
|---|---|---|---|---|
| 2013/0070093 | A1* | 3/2013 | Rivera | H04N 21/4126 348/143 |
| 2014/0039883 | A1* | 2/2014 | Yang | G10H 1/366 704/207 |
| 2014/0229831 | A1* | 8/2014 | Chordia | G10H 1/383 715/717 |
| 2016/0358595 | A1* | 12/2016 | Sung | G10H 1/368 |
| 2018/0374461 | A1* | 12/2018 | Serletic | H04N 9/8211 |
| 2018/0374462 | A1* | 12/2018 | Steinwedel | G10H 1/366 |
| 2019/0102144 | A1* | 4/2019 | Roblek | G06N 3/08 |
| 2019/0266987 | A1* | 8/2019 | Yang | G10L 21/013 |
| 2019/0355337 | A1* | 11/2019 | Steinwedel | H04N 21/42203 |
| 2021/0090541 | A1* | 3/2021 | Teng | G10L 25/81 |

* cited by examiner

SINGING SCORING METHOD AND SINGING SCORING SYSTEM BASED ON STREAMING MEDIA

CROSS-REFERENCE TO RELATED PATENT APPLICATION

This application claims the benefit of priority to Taiwan Patent Application No. 108134485, filed on Sep. 24, 2019. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a singing scoring method and a singing scoring system, and more particularly, to a singing scoring method and a singing scoring system based on streaming media.

BACKGROUND OF THE DISCLOSURE

In existing scoring methods for singing, song files (for example, music videos) are usually stored in advance in an electronic device (for example, a karaoke machine or a smartphone). Therefore, in the existing singing scoring methods, it is difficult to extend a music library due to restrictions of a storage capacity of the electronic device. In addition, because a music video with high-definition image quality usually has a relatively large file, it takes a relatively long time to download a song file to the electronic device from a cloud server before the song is able to be sung. However, due to copyright issues, the existing technology cannot be implemented if a copyright owner does not grant permission to download a song, and allows for streaming only.

In addition, even if streaming is currently a common practice used by copyright owners to grant permission, technical difficulties (e.g., network delays, a buffering time required by streaming, and a lower time precision) posed by streaming cannot be resolved in the related art. With these technical difficulties, the existing singing scoring methods cannot accurately compare sound data of the singing of a user with a singing score, resulting in an incorrect scoring and undesirable user experience. Therefore, how a singing scoring method and a singing scoring system based on streaming media can be designed has become an important subject in this field.

SUMMARY OF THE DISCLOSURE

In response to the above-referenced technical inadequacies, the present disclosure provides a singing scoring method based on streaming media. The singing scoring method is performed in an electronic device. An application program is installed to the electronic device. After the electronic device starts the application program, the electronic device generates an operation interface. The singing scoring method includes the following steps. When a user uses the operation interface to choose a song that requires an assessment for singing, the electronic device downloads a musical score of the song from a musical score server by using the application program, and starts a streaming video player to start streaming the song from a streaming server. Next, the electronic device uses the application program to detect whether the streaming video player has started playing the song. When it is detected that the streaming video player has started playing the song, the electronic device uses the application program to immediately record a system time of the electronic device, starts an audio recording program in the application program to start recording audio from a microphone device of the electronic device, and simultaneously starts a scoring engine in the application program to start comparing the musical score with sound data recorded by the audio recording program. Subsequently, the electronic device uses the application program to calculate a first time difference between a moment at which the streaming video player starts to play the song and a moment at which the electronic device starts the audio recording program and the scoring engine, and transfers the first time difference to the scoring engine. The electronic device then continuously calculates a playing time difference of the streaming video player within every fixed period of the system time by using the application program, and transfers the playing time difference to the scoring engine for accumulation to form a second time difference. The scoring engine then adjusts the musical score according to the first time difference and the second time difference, and performs the assessment for singing by comparing the adjusted musical score with the sound data recorded by the audio recording program.

In one aspect, the present disclosure further provides a singing scoring system. The singing scoring system includes the musical score server, the streaming server, and the electronic device. After the electronic device starts the application program to generate an operation interface, the application program is used to instruct the electronic device to perform the singing scoring method in the foregoing description.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION OF THE EXEMPLARY EMBODIMENTS

Figure 1:
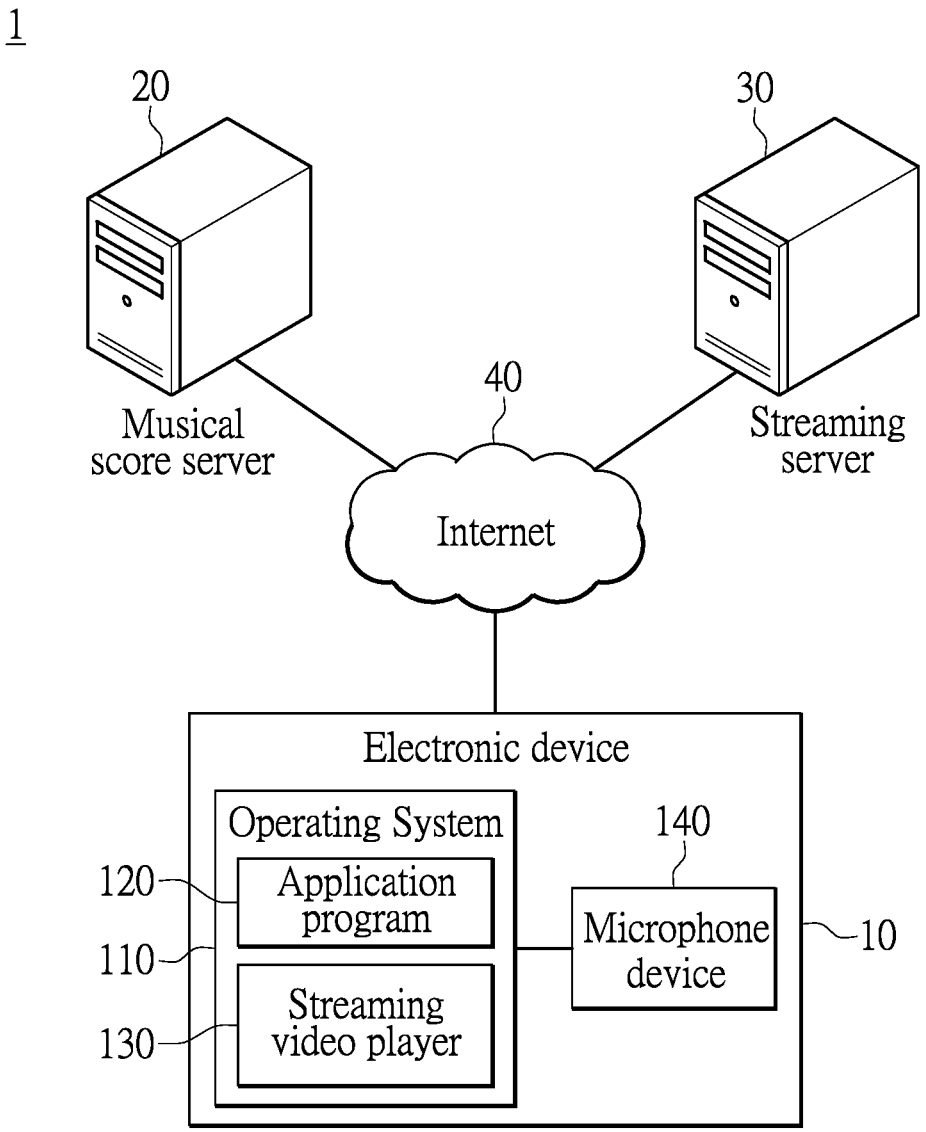
FIG. 1 is a block diagram of a singing scoring system according to an embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

Figure 2:
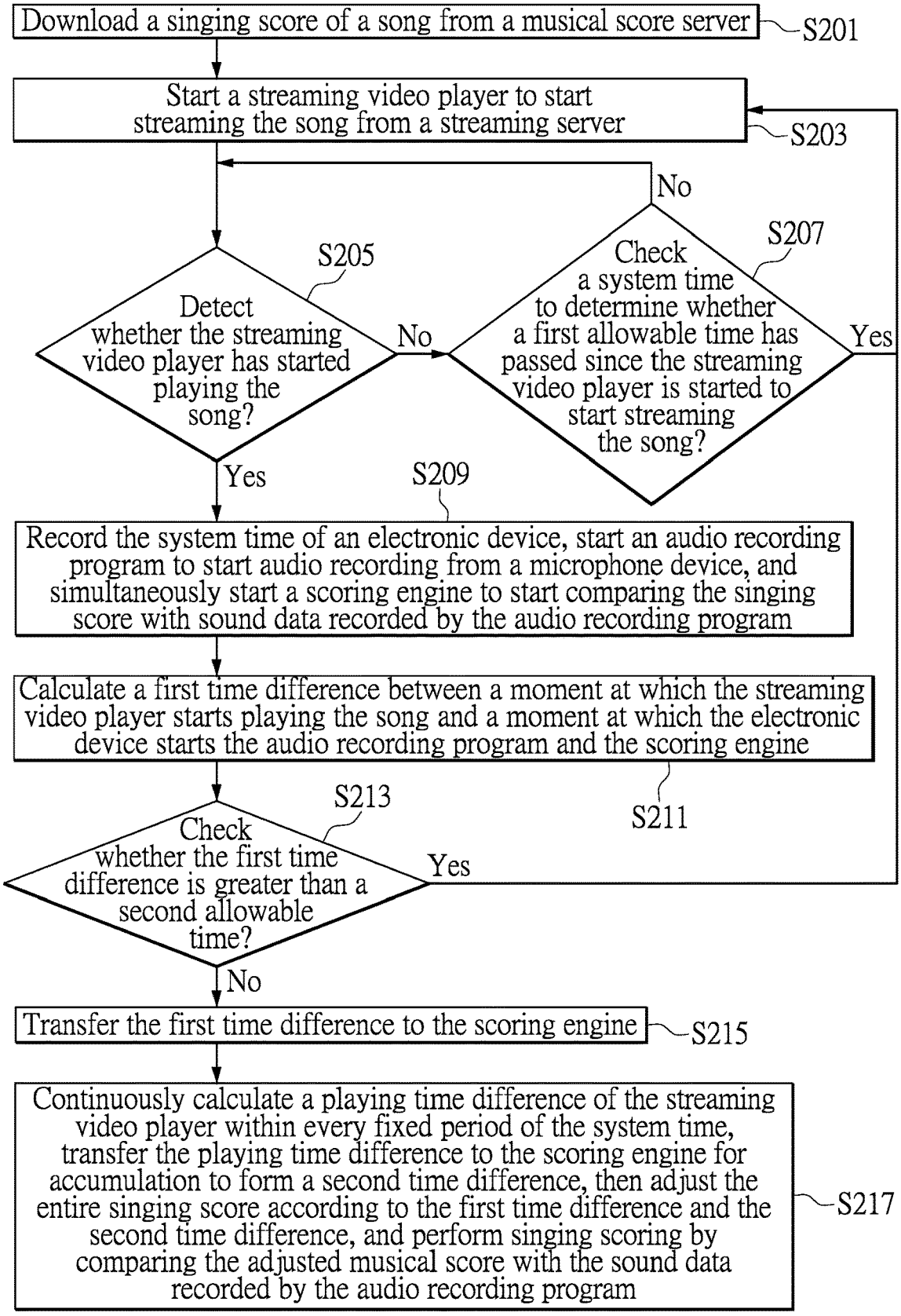
FIG. 2 is a flowchart of steps of a singing scoring method according to another embodiment of the present disclosure.

First, referring to FIG. 1 and FIG. 2, FIG. 1 is a block diagram of a singing scoring system according to an embodiment of the present disclosure, and FIG. 2 is a flowchart of steps of a singing scoring method according to another embodiment of the present disclosure. It should be noted that the singing scoring method in FIG. 2 may be performed in an electronic device 10 shown in FIG. 1. However, the present disclosure is not limited to that the singing scoring method in FIG. 2 can only be performed in the electronic device 10 shown in FIG. 1. As shown in FIG. 1, in the present disclosure, the electronic device 10, a musical score server 20, and a streaming server 30 constitute a singing scoring system 1. In this embodiment, the electronic device 10 may be connected to the musical score server 20 and the streaming server 30 via an Internet 40. Therefore, the electronic device 10 may be implemented by using, for example, a desktop computer, a notebook computer, a smartphone, a tablet computer, or any electronic device having a networking function, but the present disclosure is not limited thereto. In general, a person of ordinary skill in the art should understand that the electronic device 10 is formed by appropriate circuits and hardware, for example, a central processing unit and a memory. In addition, the electronic device 10 may include an operating system (OS) 110 and a microphone device 140, and an application program 120 that is installed to the OS 110.

The application program 120 may be implemented by using a plurality of program codes and instructions. These program codes and instructions are used to instruct the electronic device 10 to perform the singing scoring method in FIG. 2. That is, after the application program 120 is installed to (the OS 110 of) the electronic device 10, the electronic device 10 selectively starts the application program 120. It should be noted that the present disclosure is not limited to using a specific implementation for installing and starting the application program 120 on the electronic device 10, and a person of ordinary skill in the art may develop a design according to practical requirements or applications. In addition, after the electronic device 10 starts the application program 120, the electronic device 10 may generate an operation interface by using the application program 120. In this embodiment, in addition to the application program 120, a streaming video player 130 is installed to the OS 110. The streaming video player 130 and the application program 120 may be issued by different software developers, or the application program 120 may actively include the streaming video player 130. However, in both cases, the electronic device 10 can display the streaming video player 130 at the same time by using the operation interface. Moreover, the present disclosure is not limited to using a specific implementation of the streaming video player 130.

More specifically, after the electronic device 10 starts the application program 120, as shown in FIG. 2, in step S201, when a user uses the operation interface of the application program 120 to choose a song that requires an assessment for singing, the electronic device 10 downloads a musical score of the song from the musical score server 20 by using the application program 120. In step S203, the electronic device 10 starts the streaming video player 130 by using the application program 120 to start streaming the song from the streaming server 30. It should be noted that the musical score is not limited to a common musical score, but generally refers to any digital data that represents the song's pitch, a singer's singing technique, feature values that are obtained by analyzing the song, or the like and can be used to facilitate the assessment for singing. Subsequently, in step S205, the electronic device 10 uses the application program 120 to detect whether the streaming video player 130 has started playing the song. In other words, the electronic device 10 may use the application program 120 to detect whether the streaming video player 130 has received a song file streamed from the streaming server 30, completed buffering, and has started playing the song. If not (i.e., the streaming video player 130 has not started playing the song), the electronic device 10 performs step S207. If yes, the electronic device 10 performs step S209. In step S207, the electronic device 10 uses the application program 120 to check a system time of the electronic device 10 to determine whether a first allowable time (e.g., 5 seconds) has passed since the electronic device 10 started the streaming video player 130 to start streaming the song (from the streaming server 30). If not, the electronic device 10 returns to step S205. If yes, the electronic device 10 returns to step S203.

For example, when the electronic device 10 starts the streaming video player 130 to start streaming the song from the streaming server 30 in step S203, the system time of the electronic device 10 is 09:58:00:000, Aug. 5, 2019 (GMT+8). Subsequently, because the electronic device 10 detects that the streaming video player 130 has not started playing the song in step S205, the electronic device 10 checks the system time at this moment to determine whether 5 seconds has passed since 09:58:00:000, Aug. 5, 2019 (GMT+8) in step S207. If only 0.2 seconds has passed since 09:58:00:000, Aug. 5, 2019 (GMT+8) according to the system time at this moment (i.e., 09:58:00:200, Aug. 5, 2019 (GMT+8)), the electronic device 10 returns to step S205. This process is repeated until the electronic device 10 checks the system time and determines that 5 seconds has passed since 09:58:00:000, Aug. 5, 2019 (GMT+8) in step S207 (i.e., 09:58:05:000, Aug. 5, 2019 (GMT+8)). This indicates that the streaming video player 130 has not started playing the song after 5 seconds has passed since the electronic device 10 started the streaming video player 130 to start streaming the song. Therefore, the electronic device 10 may conclude that the streaming video player 130 cannot normally stream the song at this moment, and the electronic device 10 returns to step S203 to restart the streaming video player 130 to start streaming the song from the streaming server 30. It should be noted that for ease of description of this embodiment, the system time of the electronic device 10 is implemented in the form of "hour:minute:second:millisecond, month, day, year". However, the present disclosure is not limited thereto.

It should be understood that, the first allowable time is only exemplified as 5 seconds. A specific value of the first allowable time is not limited in the present disclosure. A person of ordinary skill in the art may develop a design according to actual requirements or applications. In another embodiment, the electronic device 10 may omit step S207 without affecting the implementation of the present disclosure. That is, in an embodiment without step S207, when the electronic device 10 has started the streaming video player 130 to start streaming the song but the streaming video player 130 has not started playing the song, the electronic device 10 keeps repeating step S205 until it is detected that the streaming video player 130 has started playing the song. It should further be noted that the electronic device 10 may use the application program 120 to read a playing time of the streaming video player 130 at intervals to detect whether the streaming video player 130 has started playing the song. Moreover, the present disclosure is not limited to using a specific implementation of step S205. In addition, in step S209, the electronic device 10 uses the application program 120 to immediately record the system time of the electronic device 10, starts an audio recording program (not shown) in the application program 120 to start audio recording from the microphone device 140, and simultaneously starts a scoring engine (not shown) in the application program 120 to start comparing the musical score with sound data recorded by the audio recording program.

It should be noted that, due to restrictions of capabilities of the memory and the central processing unit of the electronic device 10, when it is detected that the streaming video player 130 has started playing the song, the electronic device 10 usually cannot immediately start the audio recording program and the scoring engine, but instead starts the audio recording program and the scoring engine after a delay. As a result, the user starts singing early according to the playing of the song, and the audio recording program records the sound data late. Consequently, the scoring engine cannot accurately compare the sound data of the singing of the user with the musical score. Therefore, in step S211 after step S209, the electronic device 10 uses the application program 120 to calculate a first time difference between a moment at which the streaming video player 130 starts playing the song and a moment at which the electronic device 10 starts the audio recording program and the scoring engine. For example, if the electronic device 10 detects that the system time recorded when the streaming video player 130 has started playing the song is 10:00:00:000, Aug. 5, 2019 (GMT+8), but the system time at which the electronic device 10 starts the audio recording program and the scoring engine is 10:00:03:000, Aug. 5, 2019 (GMT+8), this indicates that the electronic device 10 may use the application program 120 to calculate and conclude that the first time difference is 3 seconds. In other words, when the electronic device 10 detects that the streaming video player 130 has started playing the song, the electronic device 10 starts the audio recording program and the scoring engine after a delay of 3 seconds. As a result, the user starts singing 3 seconds early according to the playing of the song, and the audio recording program records the sound data 3 seconds late.

How the scoring engine continues to effectively perform scoring without being affected by premature singing of the user and a belated recording of the audio recording program is described below, and therefore details thereof are not described in detail here. It should be understood that because a positive number is used in this embodiment to indicate a delay after which the electronic device 10 starts the audio recording program and the scoring engine, a value of the first time difference may be greater than or equal to 0. If the value is 0, this indicates that when the electronic device 10 detects that the streaming video player 130 has started playing the song, the electronic device 10 also immediately starts the audio recording program and the scoring engine without a delay. In contrast, the electronic device 10 may also use the application program 120 to perform comparison on the playing time of the streaming video player 130 to calculate the first time difference. For example, if the playing time at which the streaming video player 130 has started playing the song is 0:00:00:000, but the playing time of the streaming video player 130 is 0:00:03:000 when the electronic device 10 starts the audio recording program and the scoring engine, this indicates that the electronic device 10 may use the application program 120 to calculate that the first time difference is 3 seconds. Moreover, the present disclosure is not limited to using a specific implementation in which the electronic device 10 uses the application program 120 to calculate the first time difference. A person of ordinary skill in the art may develop a design according to actual requirements or applications. Similarly, for ease of description of this embodiment, the playing time of the streaming video player 130 is implemented in the form of "hour:minute:second:millisecond". However, this form is also not used to limit the present disclosure.

In addition, in another embodiment, the user may also use the operation interface of the application program 120 to choose to perform the assessment for singing from a refrain of the song. Therefore, at this moment, the streaming video player 130 does not start playing the song from 0:00:00:000. This, however, does not affect the implementation of the present disclosure. Subsequently, in step S213, the electronic device 10 uses the application program 120 to check whether the first time difference is greater than a second allowable time (e.g., 5 seconds). If yes, the electronic device 10 concludes that at this moment the scoring engine is severely affected by premature singing of the user and the belated recording of the audio recording program and cannot effectively perform scoring. Therefore, the electronic device 10 returns to step S203 to restart the streaming video player 130 to start streaming the song from the streaming server 30. If not, the electronic device 10 performs step S215 to transfer the first time difference to the scoring engine. Similarly, it is only an example that the second allowable time is 5 seconds. A specific value of the second allowable time is not limited in the present disclosure. A person of ordinary skill in the art may develop a design according to practical requirements or applications. In another embodiment, the electronic device 10 may also omit step S213 without affecting the implementation of the present disclosure.

Finally, in step S217, the electronic device 10 uses the application program 120 to continuously calculate a playing time difference of the streaming video player 130 within every fixed period (e.g., 0.1 seconds) of the system time, and transfers the playing time difference to the scoring engine for accumulation to form a second time difference. The scoring engine then adjusts the entire musical score according to the first time difference and the second time difference, and performs the assessment for singing by comparing the adjusted musical score with the sound data recorded by the audio recording program. For example, since the streaming video player 130 starts playing the song, if the system time of the electronic device 10 changes from 10:00:00:000, Aug. 5, 2019 (GMT+8) to 10:00:00:100, Aug. 5, 2019 (GMT+8) and 0.1 seconds has passed, the playing time of the streaming video player 130 should also change from 0:00:00:000 to 0:00:00:100 and 0.1 seconds has passed. However, due to unstable network transmission, at this moment, a streaming may be late or early. For example, when it is assumed that the electronic device 10 uses the application program 120 to detect that at this moment the playing time changes from 0:00:00:000 to 0:00:00:090 and only 0.09 seconds has passed, this indicates that the streaming is 0.01 seconds late at this moment. Therefore, the electronic device 10 may use the application program 120 to calculate that the playing time difference is +0.01 seconds at this moment, which is a result obtained by subtracting 0.09 seconds from 0.1 seconds. In this embodiment, the playing time difference at this moment may be referred to as $D_1$ for short, and the playing time difference $D_1$ is transferred to the scoring engine. In addition, now that the scoring engine currently only receives the playing time difference $D_1$, the second time difference at this moment is +0.01 seconds.

How the scoring engine adjusts the musical score according to the first time difference and the second time difference and performs the assessment for singing by comparing the adjusted musical score with the sound data recorded by the audio recording program is described below, and therefore details thereof are not described in detail here. It should be understood that the fixed period is only exemplified as 0.1 seconds. A specific value of the fixed period is not limited in the present disclosure. A person of ordinary skill in the art may develop a design according to actual requirements or applications.

Subsequently, if the system time of the electronic device 10 changes from 10:00:00:100, Aug. 5, 2019 (GMT+8) to 10:00:00:200, Aug. 5, 2019 (GMT+8), and 0.1 more seconds has passed, the playing time of the streaming video player 130 should also change from 0:00:00:090 to 0:00:00:190 and 0.1 seconds has passed. However, the playing time at this moment changes from 0:00:00:090 to 0:00:00:170 and only 0.08 seconds has passed. This indicates that at this moment the streaming is 0.02 seconds late. Therefore, the electronic device 10 may use the application program 120 to calculate that the playing time difference at this moment is +0.02 seconds, which is a result of subtracting 0.08 seconds from 0.1 seconds. In this embodiment, the playing time difference at this moment is referred to as $D_2$, and the playing time difference $D_2$ is transferred to the scoring engine. In addition, now that the scoring engine has received the playing time difference $D_1$ at a previous moment, the second time difference at this moment is +0.03 seconds, that is, a sum of the playing time differences $D_1$ and $D_2$.

Similarly, if the system time of the electronic device 10 changes from 10:00:00:200, Aug. 5, 2019 (GMT+8) to 10:00:00:300, Aug. 5, 2019 (GMT+8) and another 0.1 seconds has passed but the playing time at this moment changes from 0:00:00:170 to 0:00:00:280 and 0.11 seconds has passed, this indicates that the streaming at this moment is 0.01 seconds early. Therefore, the electronic device 10 may use the application program 120 to calculate that a playing time difference $D_3$ at this moment is −0.01 seconds, and the second time difference at this moment is +0.02 seconds. In other words, every time 0.1 seconds has passed for the system time of the electronic device 10, the electronic device 10 may use the application program 120 to detect whether it is also 0.1 seconds that has passed for the playing time of the streaming video player 130, and a difference at this moment is calculated and used as a playing time difference $D_i$. Because subsequent details are similar to those in the content discussed above, details thereof are not described herein again. In general, because a positive number and a negative number are used to indicate how long a streaming is late and how long a streaming is early in this embodiment, the values of the playing time difference $D_i$ and the second time difference may be zeros, positive values or negative values, and an accumulation formula of the second time difference may be represented as $\Sigma_{i=1}^{T/dt} D_i$, where i is a positive integer from 1 to (T/dt), and dt is the fixed period. In addition, in this embodiment, T may be first assumed as a total duration of the song, and when the total duration of the song is, for example, 180 seconds, i is a positive integer from 1 to 1800.

To reduce the computing burden of the electronic device 10, T may alternatively be taken as a third allowable time (e.g., 10 seconds) in the application program 120. Therefore, i is a positive integer from 1 to 100. That is, it is only within this 10 seconds that the electronic device 10 uses the application program 120 to continuously calculate the playing time difference of the streaming video player 130 within every 0.1 seconds of the system time, and the playing time difference is transferred to the scoring engine for accumulation to form the second time difference. A benefit of this is that if within this 10 seconds, the electronic device 10 uses the application program 120 to detect that a value of the second time difference is greater than or equal to a positive threshold value (e.g., +3) or is less than or equal to a negative threshold value (e.g., −3), the electronic device 10 can conclude that at this moment the streaming is excessively late or early. Consequently, the scoring engine may fail to effectively perform scoring. Therefore, the electronic device 10 may also return to step S203 to restart the streaming video player 130 to start streaming the song from the streaming server 30.

It should be noted that because a positive number and a negative number are used to indicate how long a streaming is late and how long a streaming is early respectively in this embodiment, when the value of the second time difference is greater than or equal to the positive threshold value, the electronic device 10 concludes that the streaming at this moment is excessively late. When the value of the second time difference is less than or equal to the negative threshold value, the electronic device 10 concludes that the streaming at this moment is excessively early. However, if in another embodiment, a negative number and a positive number are used to indicate how long the streaming is late and how long the streaming is early respectively, the foregoing conclusion results would be vice versa. Details thereof are not described herein again. In addition, the present disclosure does not limit that absolute values of the positive and negative threshold values to be necessarily the same or different. However, if the absolute values of the two are the same, it may also be simplified such that the electronic device 10 uses the application program 120 to detect whether the absolute value of the second time difference is greater than or equal to a threshold value (e.g., 3). Because subsequent details are similar to those in the content discussed above, details thereof are not described herein again. Similarly, the third allowable time is only exemplified as 10 seconds. A specific value of the third allowable time is not limited in the present disclosure. A person of ordinary skill in the art may develop a design according to practical requirements or applications.

In another aspect, when the electronic device 10 starts the audio recording program and the scoring engine, the electronic device 10 may start measuring a singing time. It is assumed that the song has n notes, and each note is represented by $N_k$, wherein k is a positive integer from 1 to n, and an original singing time of each note is represented by $T_k$. Therefore, in this embodiment, the musical score of the song may be represented by ($N_k$, $T_k$). That is, in the conventional technology, the scoring engine compares a note sung by the user at a singing time $T_k$ with a note $N_k$ in the musical score one by one to determine whether the two notes are consistent, calculates a difference between the two notes as a score value at this moment, and eventually calculates all score values to form a scoring result of the song sung by the user. In general, the present disclosure is not limited to using a specific implementation in which the scoring engine performs scoring. A person of ordinary skill in the art may develop a design according to practical requirements or applications.

However, if the foregoing content is still used as an example, because when the electronic device 10 detects that the streaming video player 130 has started playing the song, the electronic device 10 starts the audio recording program and the scoring engine after a delay of 3 seconds, the user starts singing 3 seconds early according to the playing of the song. In other words, a singing time that needs to be used by the scoring engine is 3 seconds later than the playing time of the streaming video player 130. In addition, the streaming may be late or early since the streaming video player 130 starts playing the song. Therefore, when the scoring engine obtains the first time difference and the second time difference, and the first time difference and the second time difference are referred to as $\Delta t1$ and $\Delta t2$ respectively in this embodiment, the scoring engine may immediately adjust the musical score to ($N_k$, $T_k-\Delta t1+\Delta t2$), and a note in a singing time ($T_k-\Delta t1+\Delta t2$) sung by the user is then compared with the note $N_k$ in the musical score to determine whether the two notes are consistent to calculate a score value at this moment.

For example, it is assumed that an original singing time of a note "Do" is 4.05 seconds, and from the system time 10:00:03:900, Aug. 5, 2019 (GMT+8) to the system time 10:00:04:000, Aug. 5, 2019 (GMT+8), the second time difference is accumulated as +0.05 seconds in the electronic device 10. This indicates that the scoring engine may immediately adjust the singing time of the note "Do" to 1.1 seconds (i.e., 4.05−3+0.05=1.1), and a note sung by the user in the singing time of 1.1 seconds is then compared with the note "Do" to determine whether the two notes are consistent to calculate a score value at this moment. Similarly, it is assumed that an original singing time of another note "Re" is 4.37 seconds, and from the system time 10:00:04:200, Aug. 5, 2019 (GMT+8) to the system time 10:00:04:300, Aug. 5, 2019 (GMT+8), the second time difference is accumulated as 0 seconds in the electronic device 10. This indicates that the scoring engine may immediately adjust a singing time of the note "Re" to 1.37 seconds, that is, 4.37−3+0=1.37, and a note sung by the user within the singing time of 1.37 seconds is then compared with the note "Re" to determine whether the two notes are consistent to calculate a score value at this moment.

Since subsequent details are similar to those in the content discussed above, details thereof are not described herein again. In general, the first time difference is subtracted from an original singing time of each note $N_k$ to counteract an impact caused when the singing time starts later than the playing time of the streaming video player 130, and the original singing time of each note $N_k$ is added to the second time difference accumulated through the system time closest thereto to counteract an impact of the belated or premature streaming within this period. It should be understood that if in another embodiment, a negative number is used instead to indicate a delay after which the electronic device 10 starts the audio recording program and the scoring engine, and a negative number and a positive number are used instead to indicate how long a streaming is late or how long a streaming is early respectively, the scoring engine adjusts the musical score to ($N_k$, $T_k+\Delta t1-\Delta t2$), and a note sung by the user within the singing time of ($T_k+\Delta t1-\Delta t2$) is then compared with the note $N_k$ in the musical score to determine whether the two notes are consistent to calculate a score value at this moment. However, this does not affect the implementation of the present disclosure. In addition, the fixed period dt needs to be set to be less than a singing time difference between any two consecutive notes. For example, a singing time difference between a note "Do" and a note "Re" is 0.32 seconds, that is, 4.37−4.05=0.32. Therefore, the application program 120 does not set the period dt to be greater than or equal to 0.32 seconds.

In conclusion, the embodiments of the present disclosure provide a singing scoring method and a singing scoring system based on streaming media. In the singing scoring method and the singing scoring system, a first time difference between a moment at which a streaming video player starts to play a song and a moment at which an electronic device starts an audio recording program and a scoring engine may be calculated. In the singing scoring method and the singing scoring system, a playing time difference of the streaming video player within every fixed period of a system time of the electronic device is continuously calculated, and the playing time difference is transferred to the scoring engine for accumulation to form a second time difference. The scoring engine may then adjust a singing time of each note $N_k$ in an entire musical score according to the first time difference and the second time difference. For example, the adjusted singing time is ($T_k-\Delta t1+\Delta t2$). The scoring engine then compares a note sung by a user in the singing time ($T_k-\Delta t1+\Delta t2$) with the note $N_k$ to determine whether the two notes are consistent to calculate a score value at this moment. Therefore, the singing scoring method and the singing scoring system are not limited to technical difficulties posed by streaming.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A singing scoring method based on streaming media and performed in an electronic device, wherein an application program is installed to the electronic device, after the electronic device starts the application program, the electronic device generates an operation interface, the singing scoring method comprising the following steps:

when a user uses the operation interface to choose a song that requires an assessment for singing, downloading, by the electronic device, a musical score of the song from a musical score server by using the application program, and starting a streaming video player to start streaming the song from a streaming server;

using, by the electronic device, the application program to detect whether the streaming video player has started playing the song, wherein when it is detected that the streaming video player has started playing the song, the electronic device uses the application program to immediately record a system time of the electronic device, starts an audio recording program in the application program to start recording audio from a microphone device of the electronic device, and simultaneously starts a scoring engine in the application program to start comparing the musical score with sound data recorded by the audio recording program;

using, by the electronic device, the application program to calculate a first time difference between a moment at which the streaming video player starts to play the song and a moment at which the electronic device starts the audio recording program and the scoring engine, and transferring the first time difference to the scoring engine; and continuously calculating, by the electronic device, a playing time difference of the streaming video player within every fixed period of the system time by using the application program, transferring the playing time difference to the scoring engine for accumulation to form a second time difference, then adjusting, by the scoring engine, the musical score according to the first time difference and the second time difference, and performing the assessment for singing by comparing the adjusted musical score with the sound data recorded by the audio recording program.

2. The singing scoring method according to claim 1, wherein the electronic device uses the application program to read a playing time of the streaming video player at intervals to detect whether the streaming video player has started playing the song.

3. The singing scoring method according to claim 1, further comprising:

when it is detected that the streaming video player has not started playing the song, using, by the electronic device, the application program to check the system time of the electronic device to determine whether a first allowable time has passed since the electronic device had started the streaming video player to start streaming the song, wherein if not, the electronic device returns to the step of using the application program to detect whether the streaming video player has started playing the song; or if yes, the electronic device returns to the step of starting the streaming video player to start streaming the song from the streaming server.

4. The singing scoring method according to claim 3, further comprising:

using, by the electronic device, the application program to check whether the first time difference is greater than a second allowable time, wherein if yes, the electronic device returns to the step of starting the streaming video player to start streaming the song from the streaming server; or if not, the electronic device transfers the first time difference to the scoring engine.

5. The singing scoring method according to claim 4, wherein the application program uses a positive number to indicate a delay after which the electronic device starts the audio recording program and the scoring engine, and uses a positive number and a negative number to indicate how long a streaming is late and how long a streaming is early, respectively.

6. The singing scoring method according to claim 5, wherein the song has a plurality of notes, each note corresponds to one singing time to form the musical score, and the scoring engine adjusts the singing time of each note in the musical score according to the first time difference and the second time difference, wherein the adjusted singing time is $(T_k-\Delta t1+\Delta t2)$, $T_k$ is the singing time before adjustment, and $\Delta t1$ and $\Delta t2$ are the first time difference and the second time difference, respectively.

7. The singing scoring method according to claim 4, wherein the application program uses a negative number to indicate a delay after which the electronic device starts the audio recording program and the scoring engine, and uses a negative number and a positive number to indicate how long a streaming is late and how long a streaming is early, respectively.

8. The singing scoring method according to claim 7, wherein the song has a plurality of notes, each note corresponds to one singing time to form the musical score, and the scoring engine adjusts the singing time of each note in the musical score according to the first time difference and the second time difference, wherein the adjusted singing time is $(T_k+\Delta t1-\Delta t2)$, $T_k$ is the singing time before adjustment, and $\Delta t1$ and $\Delta t2$ are the first time difference and the second time difference, respectively.

9. The singing scoring method according to claim 4, wherein a formula for accumulating the second time difference is represented as $\Sigma_{i=1}^{T/dt} D_i$, wherein $D_i$ is the playing time difference, T is a third allowable time, dt is the fixed period, and the singing scoring method further comprises:

using, by the electronic device, the application program to detect whether a value of the second time difference is greater than or equal to a positive threshold value or less than or equal to a negative threshold value, wherein if yes, the electronic device returns to the step of starting the streaming video player to start streaming the song from the streaming server; or if not, the scoring engine adjusts the musical score according to the first time difference and the second time difference, and performs the assessment for singing by comparing the adjusted musical score with the sound data recorded by the audio recording program.

10. The singing scoring method according to claim 4, wherein a formula for accumulating the second time difference is represented as $\Sigma_{i=1}^{T/dt} D_i$ wherein $D_i$ is the playing time difference, T is a third allowable time, dt is the fixed period, and the singing scoring method further comprises:

using, by the electronic device, the application program to detect whether the absolute value of the second time difference is greater than or equal to a threshold value, wherein if yes, the electronic device returns to the step of starting the streaming video player to start streaming the song from the streaming server; or if not, the scoring engine adjusts the musical score according to the first time difference and the second time difference, and performs the assessment for singing by comparing the adjusted musical score with the sound data recorded by the audio recording program.

11. A singing scoring system based on streaming media, comprising:

a musical score server;

a streaming server; and an electronic device, wherein an application program is installed to the electronic device, and after the electronic device starts the application program to generate an operation interface, the application program is used to instruct the electronic device to perform a singing scoring method, the singing scoring method comprising the following steps:

when a user uses the operation interface to choose a song that requires an assessment for singing, downloading, by the electronic device, a musical score of the song from the musical score server by using the application program, and starting a streaming video player to start streaming the song from the streaming server;

using, by the electronic device, the application program to detect whether the streaming video player has started playing the song, wherein when it is detected that the streaming video player has started playing the song, the electronic device uses the application program to immediately record a system time of the electronic device, starts an audio recording program in the application program to start recording audio from a microphone device of the electronic device, and simultaneously starts a scoring engine in the application program to start comparing the musical score with sound data recorded by the audio recording program;

using, by the electronic device, the application program to calculate a first time difference between a moment at which the streaming video player starts to play the song and a moment at which the electronic device starts the audio recording program and the scoring engine, and transferring the first time difference to the scoring engine; and continuously calculating, by the electronic device, a playing time difference of the streaming video player within every fixed period of the system time by using the application program, transferring the playing time difference to the scoring engine for accumulation to form a second time difference, then adjusting, by the scoring engine, the musical score according to the first time difference and the second time difference, and performing the assessment for singing by comparing the adjusted musical score with the sound data recorded by the audio recording program.

12. The singing scoring system according to claim 11, wherein the electronic device uses the application program to read a playing time of the streaming video player at an interval of a period to detect whether the streaming video player has started playing the song.

13. The singing scoring system according to claim 11, wherein the singing scoring method further comprises:

when it is detected that the streaming video player has not started playing the song, using, by the electronic device, the application program to check the system time of the electronic device to determine whether a first allowable time has passed since the electronic device had started the streaming video player to start streaming the song, wherein if not, the electronic device returns to the step of using the application program to detect whether the streaming video player has started playing the song; or if yes, the electronic device returns to the step of starting the streaming video player to start streaming the song from the streaming server.

14. The singing scoring system according to claim 13, wherein the singing scoring method further comprises:

using, by the electronic device, the application program to check whether the first time difference is greater than a second allowable time, wherein if yes, the electronic device returns to the step of starting the streaming video player to start streaming the song from the streaming server; or if not, the electronic device transfers the first time difference to the scoring engine.

15. The singing scoring system according to claim 14, wherein the application program uses a positive number to indicate a delay after which the electronic device starts the audio recording program and the scoring engine, and uses a positive number and a negative number to indicate how long a streaming is late and how long a streaming is early respectively.

16. The singing scoring system according to claim 15, wherein the song has a plurality of notes, each note corresponds to one singing time to form the musical score, and the scoring engine adjusts the singing time of each note in the musical score according to the first time difference and the second time difference, wherein the adjusted singing time is $(T_k-\Delta t1+\Delta t2)$, $T_k$ is the singing time before adjustment, and $\Delta t1$ and $\Delta t2$ are the first time difference and the second time difference respectively.

17. The singing scoring system according to claim 14, wherein the application program uses a negative number to indicate a delay after which the electronic device starts the audio recording program and the scoring engine, and uses a negative number and a positive number to indicate how long a streaming is late and how long a streaming is early respectively.

18. The singing scoring system according to claim 17, wherein the song has a plurality of notes, each note corresponds to one singing time to form the musical score, and the scoring engine adjusts the singing time of each note in the musical score according to the first time difference and the second time difference, wherein the adjusted singing time is $(T_k+\Delta t1-\Delta t2)$, $T_k$ is the singing time before adjustment, and $\Delta t1$ and $\Delta t2$ are the first time difference and the second time difference, respectively.

19. The singing scoring system according to claim 14, wherein a formula for accumulating the second time difference is represented as $\Sigma_{i=1}^{T/dt} D_i$, wherein $D_i$ is the playing time difference, T is a third allowable time, and dt is the fixed period, and the singing scoring method further comprises:

using, by the electronic device, the application program to detect whether a value of the second time difference is greater than or equal to a positive threshold value or less than or equal to a negative threshold value, wherein if yes, the electronic device returns to the step of starting the streaming video player to start streaming the song from the streaming server; or if not, the scoring engine adjusts the musical score according to the first time difference and the second time difference, and performs the assessment for singing by comparing the adjusted musical score with the sound data recorded by the audio recording program.

20. The singing scoring system according to claim 14, wherein a formula for accumulating the second time difference is represented as $\Sigma_{i=1}^{T/dt} D_i$, wherein $D_i$ is the playing time difference, T is a third allowable time, dt is the fixed period, and the singing scoring method further comprises:

using, by the electronic device, the application program to detect whether the absolute value of the second time difference is greater than or equal to a threshold value, wherein if yes, the electronic device returns to the step of starting the streaming video player to start streaming the song from the streaming server; or if not, the scoring engine adjusts the musical score according to the first time difference and the second time difference, and performs the assessment for singing by comparing the adjusted musical score with the sound data recorded by the audio recording program.

* * * * *